US008878762B2

(12) United States Patent
Hsu

(10) Patent No.: US 8,878,762 B2
(45) Date of Patent: Nov. 4, 2014

(54) LEVEL SHIFTER AND SOURCE DRIVER FOR LIQUID CRYSTAL DISPLAY

(75) Inventor: Chen-Ming Hsu, Tainan County (TW)

(73) Assignee: Himax Technologies Limited, Sinshih Township, Tainan (TW)

( * ) Notice: Subject to any disclaimer, the term of this patent is extended or adjusted under 35 U.S.C. 154(b) by 584 days.

(21) Appl. No.: 12/776,516

(22) Filed: May 10, 2010

(65) Prior Publication Data

US 2011/0273415 A1 Nov. 10, 2011

(51) Int. Cl.
*G09G 3/36* (2006.01)

(52) U.S. Cl.
CPC ..... *G09G 3/3688* (2013.01); *G09G 2310/0289* (2013.01)
USPC ..... 345/98; 345/211; 345/212

(58) Field of Classification Search
USPC ..... 345/211
See application file for complete search history.

(56) References Cited

U.S. PATENT DOCUMENTS

2007/0096965 A1* 5/2007 Gillespie et al. ..... 341/144
2007/0139351 A1* 6/2007 Hashimoto ..... 345/100
2008/0111611 A1* 5/2008 Thiele et al. ..... 327/427
2008/0197880 A1* 8/2008 Fan et al. ..... 326/63
2008/0225036 A1* 9/2008 Song et al. ..... 345/213

OTHER PUBLICATIONS

Khondker, Abul; Introduction to CMOS VLSI Design Lecture 1: Circuits & Layout; 2006.*

* cited by examiner

*Primary Examiner* — Quan-Zhen Wang
*Assistant Examiner* — David Lee
(74) *Attorney, Agent, or Firm* — McClure, Qualey & Rodack, LLP

(57) ABSTRACT

A level shifter for a source driver of a liquid crystal display is provided. The level shifter includes: an input stage for generating a signal with a voltage of between a positive input source voltage and a negative input source voltage according to an input logic; a middle stage for generating a first logic signal and a second logic signal according to the signal; and an output stage, for generating a first output signal with a voltage of between a first positive output source voltage and a first negative output source voltage at a first output terminal or a second output signal with a voltage of between a second positive output source voltage and a second negative output source voltage at a second output terminal according to the first logic signal and the second logic signal.

8 Claims, 7 Drawing Sheets

LEVEL SHIFTER AND SOURCE DRIVER FOR LIQUID CRYSTAL DISPLAY

FIELD OF THE INVENTION

The present invention relates to a level shifter and a source driver for a liquid crystal display.

DESCRIPTION OF THE RELATED ART

Conventionally, a source driver can be only applied to generate alternating current (AC) common voltage or direct current (DC) common voltage. When the source driver is applied to generate AC common voltage, there are two power supplies respectively with different voltages in the source driver. When the source driver is applied to generate DC common voltage, there are two power supplies with the same voltages in the source driver. Usually, there are two different types of level shifters in the source driver for generating AC common voltage and there are two similar types of level shifters in the source driver for generating DC common voltage.

FIG. 1A is a schematic diagram showing a conventional source driver for generating AC common voltage of a liquid crystal display. There are a power supply VDDA with 5 volts and a power supply VDDAN with −5 volts in the source driver 100. There is a first level shifter 110 and a second level shifter 120 in the source driver 100. The first level shifter 110 shifts a voltage of between 0 and 1.8 volts to a voltage of between 0 and 5 volts; the second level shifter 120 shifts a voltage of between 0 and 1.8 volts to a voltage of between 0 to −5 volts.

FIG. 1B is a schematic diagram showing a conventional source driver for generating DC common voltage of a liquid crystal display. There are a power supply VDDA with 5 volts and a power supply VSSAN with 5 volts in the source driver 101. There is a first level shifter 130 and a second level shifter 140 in the source driver 101. The first level shifter 130 shifts a voltage of between 0 and 1.8 volts to a voltage of between 0 and 5 volts; and the second level shifter 140 shifts a voltage of between 0 and 1.8 volts to a voltage of between 0 to 5 volts.

In general, a level shifter which is used to shift a signal with a voltage of between 0 and 1.8 volts to another signal with a voltage of between 0 and 5.0 volts can not be used to shift a signal with a voltage of between 0 and 1.8 volts to another signal with a voltage of between 0 and −5.0 volts. Currently, based on this hardware structure, the source driver for generating AC common voltage and the source driver for generating DC common voltage are not compatible due to the level shifter.

Thus, a level shifter which is capable of shifting from one voltage range to two voltage ranges is called for.

BRIEF SUMMARY OF INVENTION

A detailed description is given in the following embodiments with reference to the accompanying drawings.

The present invention provides a level shifter for a source driver of a liquid crystal display. The level shifter for a source driver of a liquid crystal display comprises: an input stage for generating a signal with a voltage of between a positive input source voltage and a negative input source voltage according to an input logic; a middle stage for generating a first logic signal and a second logic signal according to the signal; and an output stage, for generating a first output signal with a voltage of between a first positive output source voltage and a first negative output source voltage at a first output terminal or a second output signal with a voltage of between a second positive output source voltage and a second negative output source voltage at a second output terminal according to the first logic signal and the second logic signal.

The present invention provides a source driver for a liquid crystal display. The source driver comprises: a level shifter for generating a first output signal or a second output signal according to an input logic, a first reference source and a second reference source; a digital to analog converter generating a first analog signal or a second analog signal according to the first output signal or the second output signal and the first reference source and the second reference source; and a chop device for limiting the first output signal or the second output signal according to the first reference source and the second reference source; wherein the first output signal is generated when first reference source is positive voltage and the second reference source is zero, and the second output signal is generated when the first reference source is zero and the second reference source is negative voltage.

The present invention provides a method for shifting a signal level. The method comprises: generating a signal with a voltage of between a positive input source voltage and a negative input source voltage by an input stage according to an input logic; generating a first logic signal and a second logic signal by a middle stage according to the signal; and generating a first output signal with a voltage of between a first positive output source voltage and a first negative output source voltage at a first output terminal or a second output signal with a voltage of between a second positive output source voltage and a second negative output source voltage at a second output terminal by an output stage according to the first logic signal and the second logic signal.

The above-mentioned level shifter for a source driver of a liquid crystal display and method thereof is able to shift one signal with a voltage range into two signals with respective voltage ranges. As a result, the source driver having the above-mentioned level shifter can be used to generate AC common voltage and DC common voltage.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
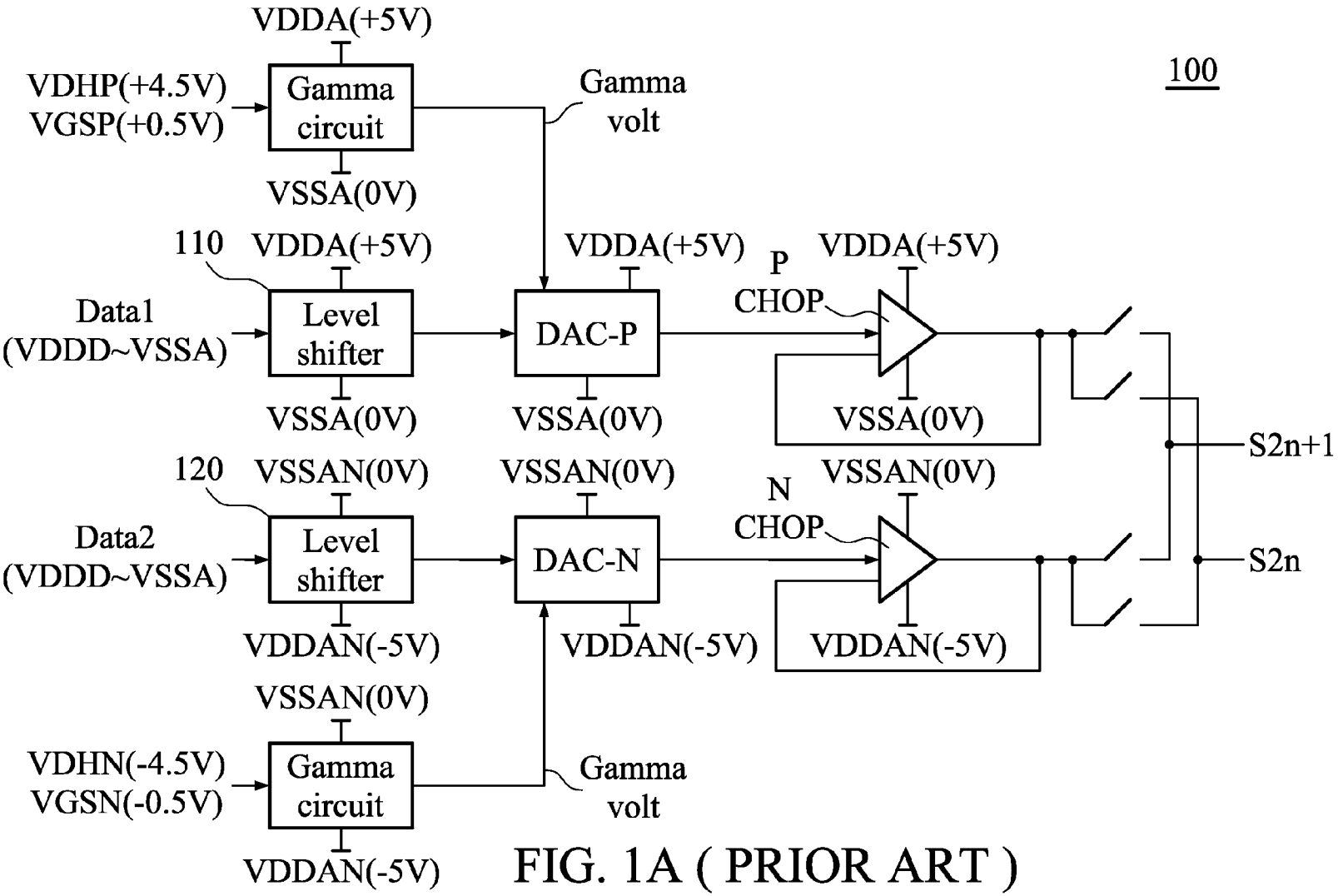
FIG. 1A ( PRIOR ART )
FIG. 1A is a schematic diagram showing a conventional source driver for generating AC common voltage of a liquid crystal display.
Figure 1B:
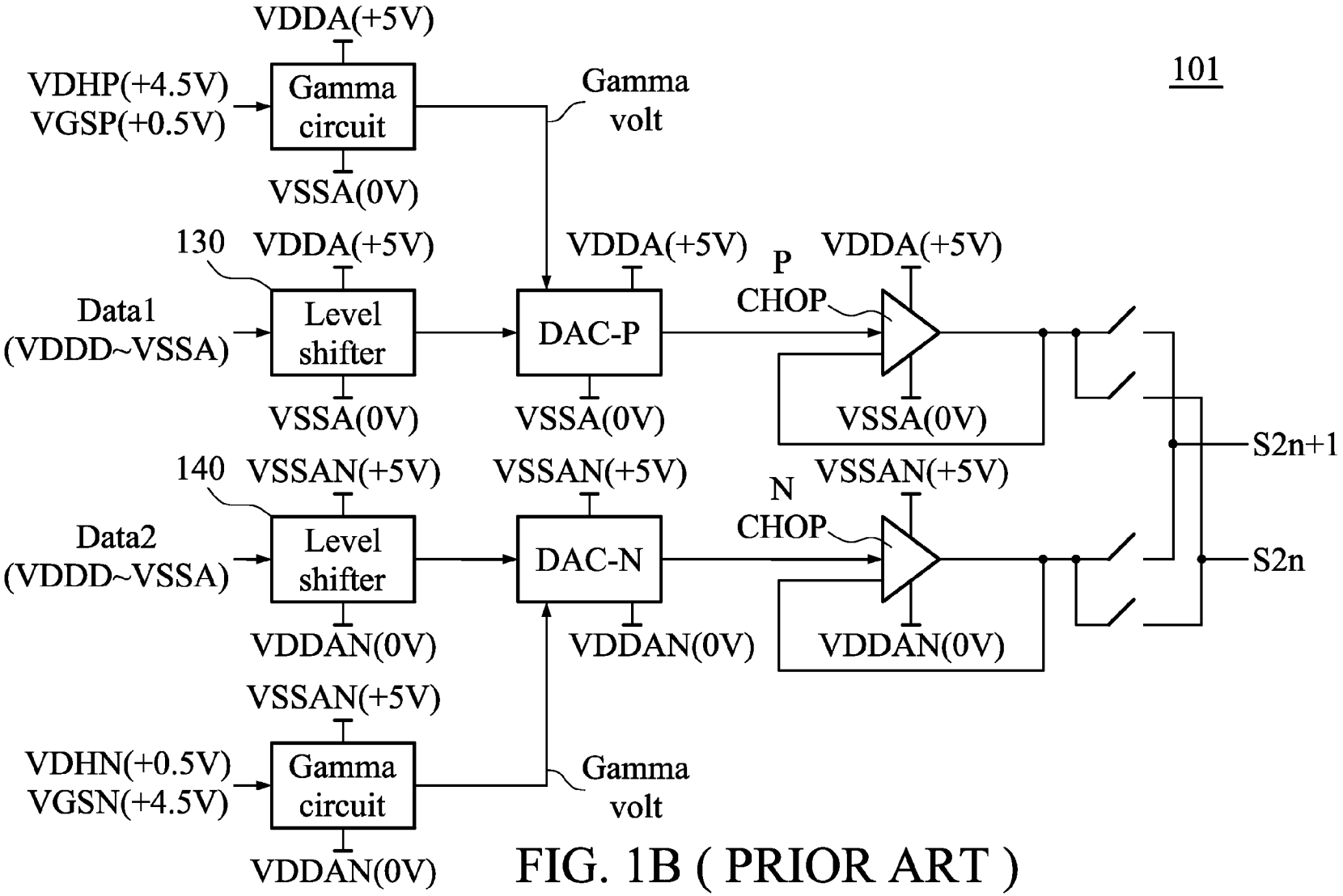
FIG. 1B ( PRIOR ART )
FIG. 1B is a schematic diagram showing a conventional source driver for generating DC common voltage of a liquid crystal display.
Figure 2:
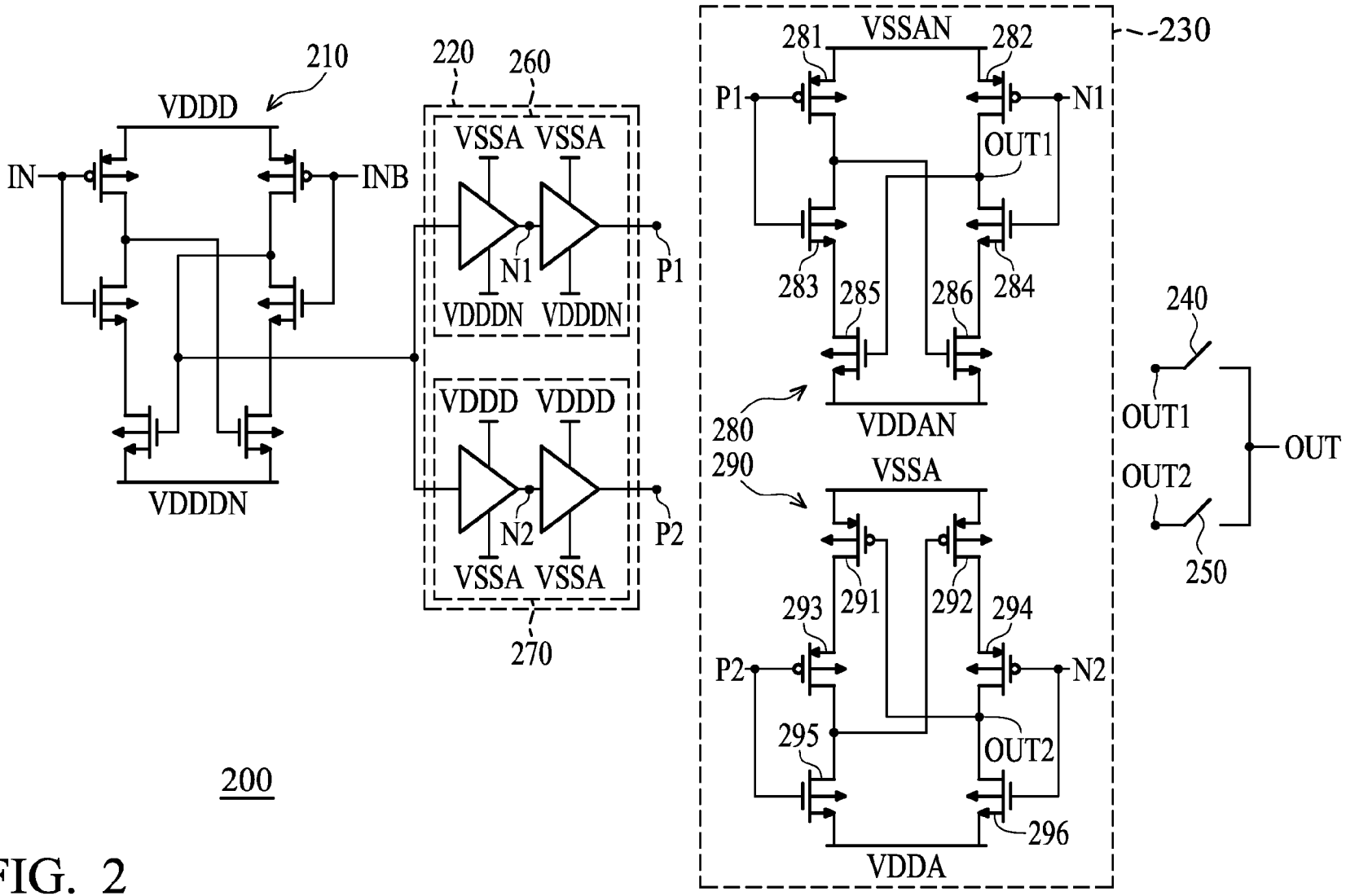
FIG. 2 is a schematic diagram showing a level shifter in a source driver of a liquid crystal display of the invention.

FIG. 2 is a schematic diagram showing a level shifter in a source driver of a liquid crystal display of the invention. The level shifter 200 includes an input stage 210, a middle stage 220, an output stage 230, a first switch 240 and a second switch 250.

The input stage 210 is used to generate a signal with a voltage of between a positive input source voltage VDDD and a negative input source voltage VDDDN according to an input logic (IN and INB). The middle stage 220 is used to generate a first logic signal and a second logic signal according to the signal. The output stage 230 is used to generate a first output signal with a voltage of between a first positive output source voltage and a first negative output source voltage at a first output terminal OUT1 or a second output signal with a voltage of between a second positive output source voltage and a second negative output source voltage at a second output terminal OUT2 according to the first logic signal and the second logic signal. The first switch 240 is turned on when the first output signal is generated; and the second switch 250 is turned on when the second output signal is generated.

The middle stage 220 further includes a first up-level circuit 260 and a first down-level circuit 270. The first up-level circuit 260 and the first down-level circuit 270 respectively have two buffers in series. The buffers may be non-inverters, but are not limited thereto. The output stage 230 further includes a second up-level circuit 280 and a second down-level circuit 290. The first output terminal OUT1 of the second up-level circuit 280 is connected to the first switch 240, and the second output terminal OUT 2 of the second down-level circuit 290 is connected to the second switch 250.

The second up-level circuit 280 further includes a first p-type transistor 281, a second p-type transistor 282, a first n-type transistor 283, a second n-type transistor 284, a third n-type transistor 285 and a fourth n-type transistor 286. The second down-level circuit 290 includes a third p-type transistor 293, a fourth p-type transistor 294, a fifth p-type transistor 291, a sixth p-type transistor 292, a fifth n-type transistor 295 and a sixth n-type transistor 296.

The first p-type transistor 281 and the second p-type transistor 282 are coupled with a first voltage source VSSAN. The first n-type transistor 283 is coupled with the first p-type transistor 281 and a second n-type transistor 284 is coupled with the second p-type transistor 282. The gate of the first p-type transistor 281 is connected with the gate of the first n-type transistor 283 and the gate of the second p-type transistor 282 is connected with the gate of the second n-type transistor 284. The third n-type transistor 285 is coupled with the first n-type transistor 283 and a second voltage source VDDAN. The fourth n-type transistor 286 is coupled with the second n-type transistor 284 and the second voltage source VDDAN. The gate of third n-type transistor 285 and the drain of the second p-type transistor 282 are connected to the first output terminal OUT1.

The fifth n-type transistor 295 and the sixth n-type transistor 296 are coupled with a third voltage source VDDA. The third p-type transistor 293 is coupled with the fifth n-type transistor 295 and a fourth p-type transistor 294 is coupled with the sixth n-type transistor 296. The gate of the fifth n-type transistor 295 is connected with the gate of the third p-type transistor 293; the gate of the sixth n-type transistor 296 is connected with the gate of the fourth p-type transistor 294. The fifth p-type transistor 291 is coupled with the third p-type transistor 293 and a fourth voltage source VSSA. The sixth p-type transistor 292 is coupled with the fourth p-type transistor 294 and the fourth voltage source VSSA. The gate of fifth p-type transistor 291 and the drain of the fourth p-type transistor 294 are connected to the second output terminal OUT2.

Figure 3:
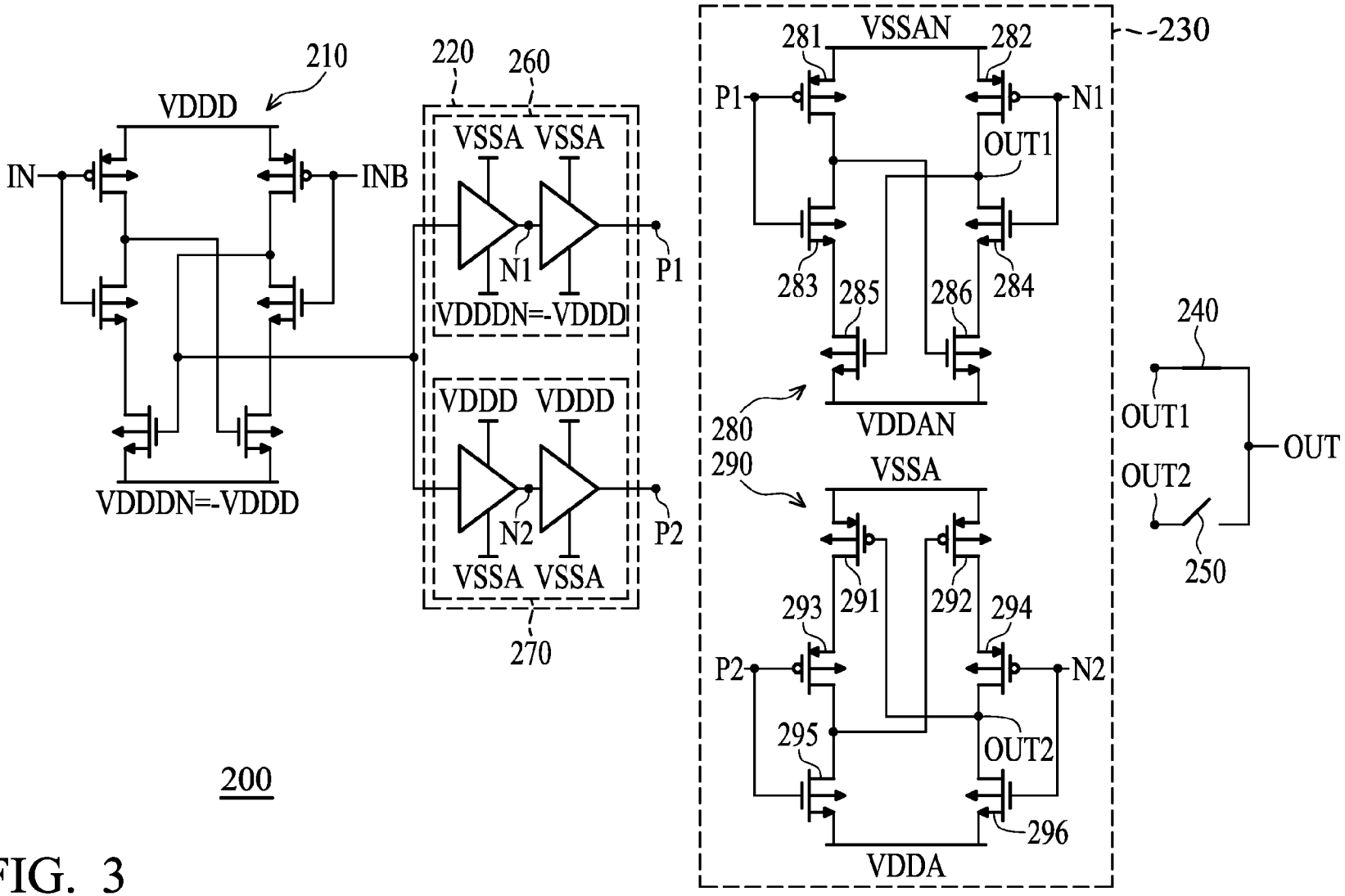
FIG. 3 is a diagram showing an embodiment of the level shifter of FIG. 2.

FIG. 3 is a diagram showing an embodiment of the level shifter of FIG. 2. In the embodiment, the positive input source voltage VDDD is 1.8 volts, and the negative input source voltage VDDDN is the negative of the positive input source voltage VDDD, i.e. −1.8 volts in the input stage 210. The output voltage of the input stage 210 is between 1.8 volts and −1.8 volts. In the middle stage 220, the first up-level circuit 260 outputs a logic signal with a voltage of between 0 and −1.8 volts, and the first down-level circuit 270 outputs a logic signal with a voltage of between 0 and 1.8 volts. In the output stage 230, the first voltage source VSSAN and the fourth voltage source VSSA are grounded, i.e. 0 volts. The second voltage source VDDAN and the third voltage source VDDA are −5 volts. In this manner, the second down-level circuit 290 will output a zero voltage signal at the second output terminal OUT2 and the second switch 250 is turned off correspondingly. At the same time, the second up-level circuit 280 will output a signal with a voltage of between 0 and −5 volts at the first output terminal OUT1 and the first switch 240 is turned on correspondingly. As a result, the potential across the second switch 250 will be limited to below 5 volts.

Figure 4:
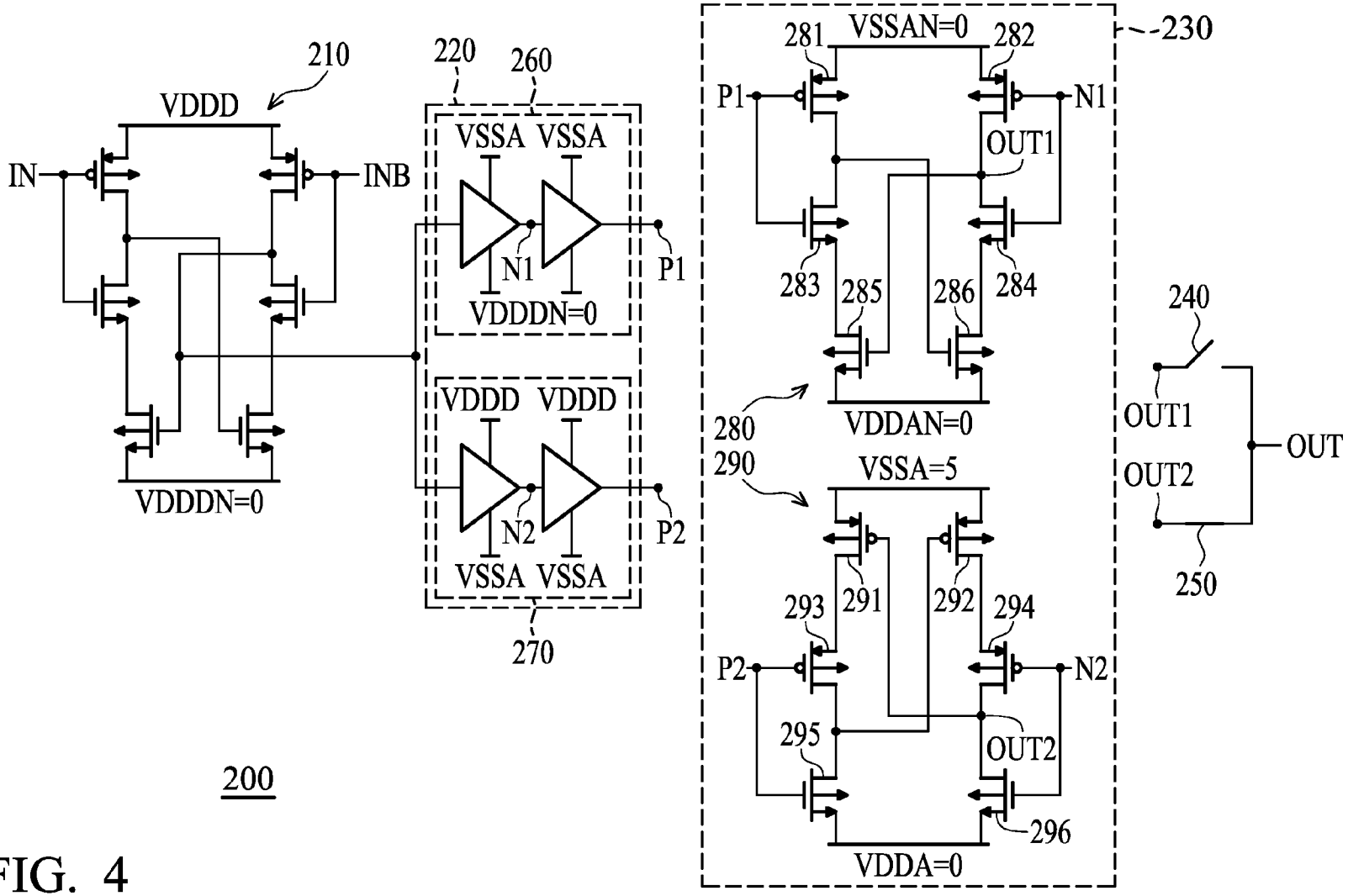
FIG. 4 is a diagram showing another embodiment of the level shifter of FIG. 2.

FIG. 4 is a diagram showing another embodiment of the level shifter of FIG. 2. In the embodiment, the positive input source voltage VDDD is 1.8 volts, and the negative input source voltage VDDDN is 0 volts in the input stage 210. The output voltage of the input stage 210 will be between 1.8 volts and 0 volts. In the middle stage 220, the first up-level circuit 260 outputs a logic signal with a voltage of 0 volts, and the first down-level circuit 270 outputs a logic signal with a voltage of between 0 and 1.8 volts. In the output stage 230, the first voltage source VSSAN, the second voltage source VDDAN and the third voltage source VDDA are grounded, i.e. 0 volts. The fourth voltage source VSSA is 5 volts. In this manner, the second up-level circuit 280 will output a zero voltage signal at the first output terminal OUT1 to turn off first switch 240. At the same time, the second down-level circuit 290 will output a signal with a voltage of between 0 and 5 volts at the second output terminal OUT2 to turn on the second switch 250. As a result, the potential across the first switch 240 will also be limited to below 5 volts.

Figure 5:
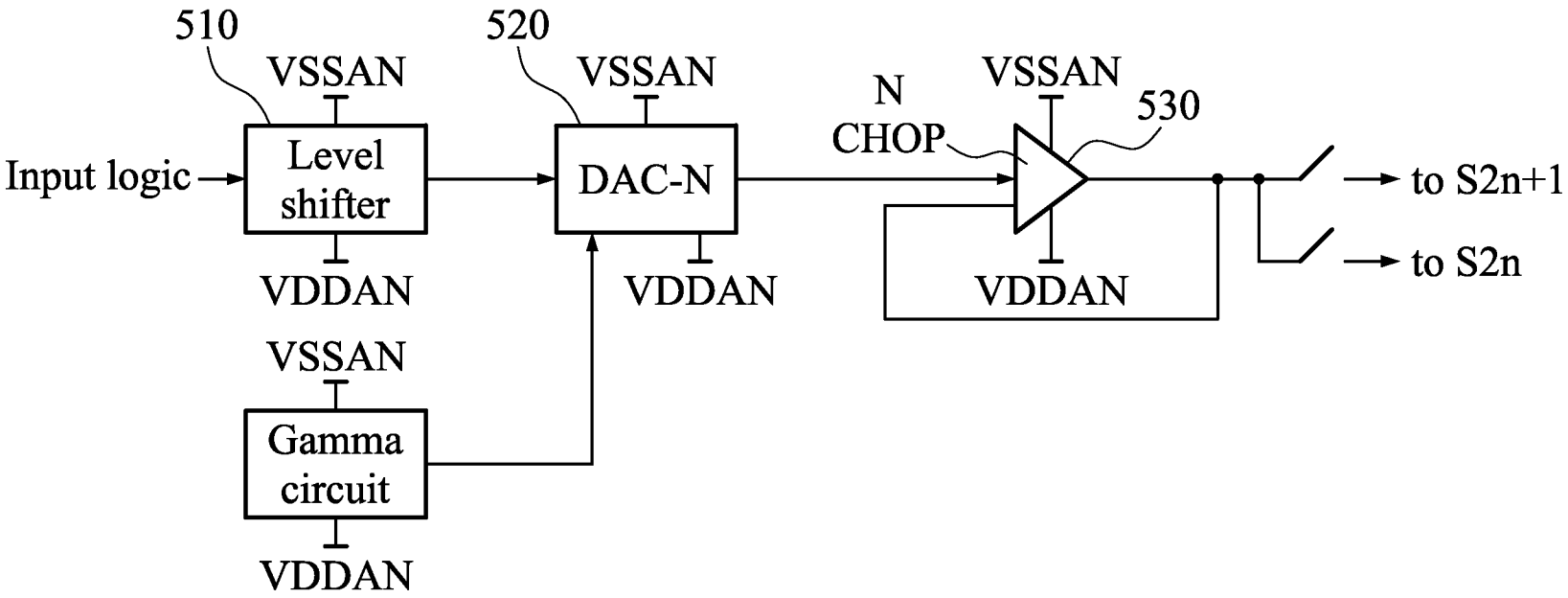
FIG. 5 is a diagram showing an embodiment of the source driver for a liquid crystal display of the invention.

FIG. 5 is a diagram showing an embodiment of the source driver for a liquid crystal display of the invention. The source driver 500 includes a level shifter 510, a digital to analog converter 520 and a chop device 530.

The level shifter 510 is as described above, which is used to generate a first output signal or a second output signal according to an input logic, a first reference source VSSAN and a second reference source VDDAN. In one embodiment, the input logic is high when its logic voltage is 1.8 volts and the input logic is low when its logic voltage is 0 volts. The first reference source VSSAN is 0 volts and the second reference source VDDAN is −5 volts and the first output signal is generated when the source driver 500 is operated to generate AC common voltage. The first reference source VSSAN is 0 volts and the second reference source VDDAN is 5 volts, and the second output signal is generated when the source driver 500 is operated to generate DC common voltage. The first output signal is a negative voltage signal and the second output signal is a positive voltage signal.

The digital to analog converter 520 is used to generate a first analog signal or a second analog signal according to the first output signal or the second output signal and the first reference source VSSAN and the second reference source VDDAN. The chop device 530 is used to limit the voltage level of the first output signal or the second output signal according to the first reference source VSSAN and the second reference source VDDAN.

Figure 6:
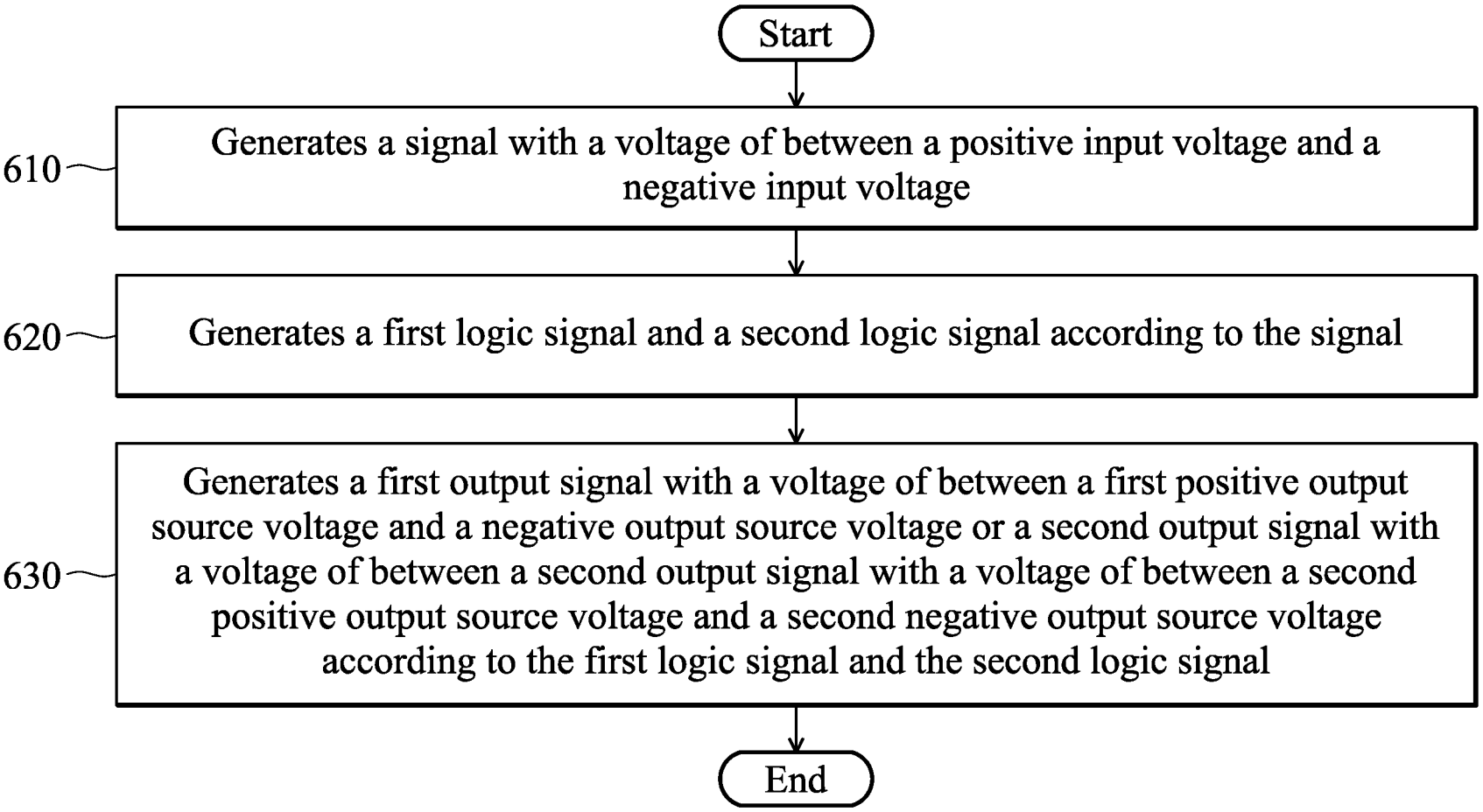
FIG. 6 is a flowchart illustrating a method for shifting a signal by using the level shifter of a source driver of a liquid crystal display of the invention.

FIG. 6 is a flowchart illustrating a method for shifting a signal by using the level shifter of a source driver of a liquid crystal display of the invention. A level shifter generates a signal with a voltage of between a positive input source voltage and a negative input source voltage by an input stage according to an input logic in step 610.

Next, the level shifter generates a first logic signal and a second logic signal by a middle stage according to the signal in step 620. The first logic signal is generated by a first up-level circuit and has a voltage of between the negative input source voltage and zero. The second logic signal is generated by a first down-level circuit and has a voltage of between zero and the positive input source voltage.

Finally, the level shifter generates a first output signal with a voltage of between a first positive output source voltage and a first negative output source voltage at a first output terminal, or a second output signal with a voltage of between a second positive output source voltage and a second negative output source voltage at a second output terminal by an output stage according to the first logic signal and the second logic signal.

The first output signal is generated by a second up-level circuit according to the first logic signal and the second output signal is generated by a second down-level circuit according to the second logic signal.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A level shifter for a source driver of a liquid crystal display, comprising:

an input stage for generating a signal with a voltage of between a positive input source voltage and a negative input source voltage according to an input logic;

a middle stage for generating a first logic signal, an inverted first logic signal, a second logic signal, and an inverted second logic signal according to the signal; and an output stage, receiving the first logic signal, the inverted first logic signal, the second logic signal, and the inverted second logic signal, for generating a first output signal with a voltage of between a first positive output source voltage and a first negative output source voltage at a first output terminal using the received first logic signal and the received inverted first logic signal and a second output signal with a voltage of between a second positive output source voltage and a second negative output source voltage at a second output terminal using the received second logic signal and the received inverted second logic signal, wherein the output stage further comprises:

a second up-level circuit for generating the first output signal according to the first logic signal and the inverted first logic signal, wherein the second up-level circuit further comprises:

a first p-type transistor and a second p-type transistor, coupled with a first voltage source;

a first n-type transistor, coupled with the first p-type transistor and a second n-type transistor, coupled with the second p-type transistor, wherein the gate of the first p-type transistor is connected with the gate of the first n-type transistor, and the gate of the second p-type transistor is connected with the gate of the second n-type transistor;

a third n-type transistor, coupled with the first n-type transistor and a second voltage source; and a fourth n-type transistor, coupled with the second n-type transistor and the second voltage source, wherein the gate of third n-type transistor and the drain of the second p-type transistor are connected to the first output terminal; and a second down-level circuit for generating the second output signal according to the second logic signal and the inverted second signal.

2. The level shifter as claimed in claim 1, further comprising:

a first switch connected with the first output terminal; and a second switch connected with the second output terminal, wherein the first switch is turned on when the first output signal is generated; and the second switch is turned on when the second output signal is generated.

3. The level shifter as claimed in claim 1, wherein the middle stage further comprises:

a first up-level circuit for generating the first logic signal with a voltage of between the negative input source voltage and zero;

a first down-level circuit for generating the second logic signal with a voltage of between zero and the positive input source voltage.

4. The level shifter as claimed in claim 3, wherein the first up-level circuit and the second down-level respectively comprise two buffers connected in series.

5. A source driver for a liquid crystal display comprising:

a level shifter as claimed in claim 1 for generating a first output signal or a second output signal according to an input logic, a first reference source and a second reference source;

a digital to analog converter generating a first analog signal or a second analog signal according to the first output signal or the second output signal and the first reference source and the second reference source; and a chop device for limiting the voltage level of the first output signal or the second output signal according to the first reference source and the second reference source, wherein the first output signal is generated when first reference source is positive voltage and the second reference source is zero, and the second output signal is generated when the first reference source is zero and the second reference source is negative voltage.

6. The source driver as claimed in claim 5, wherein the first output signal is a negative voltage signal and the second output signal is a positive voltage signal.

7. The level shifter as claimed in claim 1, further comprising a switch stage for outputting the first output signal when the second output signal is zero and the second output signal when the first output is zero.

8. A level shifter for a source driver of a liquid crystal display, comprising:

an input stage for generating a signal with a voltage of between a positive input source voltage and a negative input source voltage according to an input logic;

a middle stage for generating a first logic signal, an inverted first logic signal, a second logic signal, and an inverted second logic signal according to the signal; and an output stage, receiving the first logic signal, the inverted first logic signal, the second logic signal, and the inverted second logic signal, for generating a first output signal with a voltage of between a first positive output source voltage and a first negative output source voltage at a first output terminal using the received first logic signal and the received inverted first logic signal and a second output signal with a voltage of between a second positive output source voltage and a second negative output source voltage at a second output terminal using the received second logic signal and the received inverted second logic signal, wherein the output stage further comprises:

a second up-level circuit for generating the first output signal according to the first logic signal and the inverted first logic signal; and a second down-level circuit for generating the second output signal according to the second logic signal and the inverted second signal, wherein the second down-level circuit further comprises:

a fifth n-type transistor and a sixth n-type transistor, coupled with a third voltage source;

a third p-type transistor, coupled with the fifth n-type transistor and a fourth p-type transistor, coupled with the sixth n-type transistor, wherein the gate of the fifth n-type transistor is connected with the gate of the third p-type transistor, and the gate of the sixth n-type transistor is connected with the gate of the fourth p-type transistor;

a fifth p-type transistor, coupled with the third p-type transistor and a fourth voltage source; and a sixth p-type transistor, coupled with the fourth p-type transistor and the fourth voltage source, wherein the gate of fifth p-type transistor and the drain of the fourth p-type transistor are connected to the second output terminal.

* * * * *